United States Patent [19]

Hewison

[11] Patent Number: 4,616,455

[45] Date of Patent: Oct. 14, 1986

[54] FASTENING ASSEMBLY

[75] Inventor: George D. Hewison, Hants, England

[73] Assignee: ITW Limited, Windsor, England

[21] Appl. No.: 689,410

[22] Filed: Jan. 7, 1985

[30] Foreign Application Priority Data

Jan. 9, 1984 [GB] United Kingdom ..... 8400388
May 25, 1984 [GB] United Kingdom ..... 8413277

[51] Int. Cl.[4] ..... E04B 5/00; E04B 7/00; F16B 23/00; F16B 25/00

[52] U.S. Cl. ..... 52/127.12; 52/309.1; 52/410; 52/512; 52/713; 411/383; 411/387; 411/392; 411/397

[58] Field of Search ..... 52/410, 378, 705, 707, 52/704, 127.7, 127.12, 713, 506, 512, 309.1; 411/392, 383, 384, 396, 397, 341, 342, 16, 17, 386, 387, 3, 103, 411

[56] References Cited

U.S. PATENT DOCUMENTS

| | | | |
|---|---|---|---|
| 1,102,871 | 7/1914 | Carroll | 52/549 |
| 2,067,252 | 1/1937 | Whelan | 52/222 |
| 2,210,441 | 8/1940 | Bachman | 52/705 X |
| 3,335,536 | 8/1967 | McCord | 52/512 X |
| 3,378,975 | 4/1968 | Hill | 52/713 X |
| 3,517,581 | 6/1970 | Stokes et al. | 411/387 |
| 3,604,492 | 9/1971 | Bayer | 52/707 X |
| 4,361,997 | 12/1982 | DeCaro | 52/410 X |
| 4,452,023 | 6/1984 | Stahlberg | 52/410 X |
| 4,455,804 | 6/1984 | Francovitch | 52/410 X |

FOREIGN PATENT DOCUMENTS

| | | | |
|---|---|---|---|
| 347301 | 1/1922 | Fed. Rep. of Germany | 52/707 |
| 529429 | 7/1931 | Fed. Rep. of Germany | 52/167 |
| 2711335 | 9/1978 | Fed. Rep. of Germany | 52/410 |
| 2514086 | 4/1983 | France | 411/103 |
| 271028 | 4/1965 | Netherlands | 52/713 |
| 379230 | 6/1964 | Switzerland | 411/392 |

*Primary Examiner*—Alfred C. Perham
*Assistant Examiner*—Jean M. LaKemper
*Attorney, Agent, or Firm*—David I. Roche; Thomas W. Buckman

[57] ABSTRACT

A fastening assembly for use in fastening a thick insulating layer 8, typically between 130 and 300 mm, onto a roof decking 9 comprises a self drilling and self tapping screw-threaded fastener 1 having a driving head 11; a load distributing plate 2 for engaging the upper surface of the insulation material 8 to hold it and distribute the fastening load so that the fastening assembly does not pull through the insulation material; and, an extensible resilient member 3 having one end 6 coupled to the head of the screw-threaded fastener 1 and the other end coupled to the load distributing plate 2. At least one coupling permit the screw-threaded fastener 1 to rotate with respect to the load distributing plate 2 to allow the fastener 1 to be driven through and screwed into the roof decking 9 to fasten the insulation material 8. The provision of a resilient element 3 accommodates minor variations in the manufacture of the insulation material, and distortions and deformations of it that occur in use. The resilient element 3 also accommodates any lateral movement of the load-distributing plate and the screw-threaded fastener caused by, for example, thermal expansion and contraction or settlement of the building.

13 Claims, 7 Drawing Figures

Fig. 1.
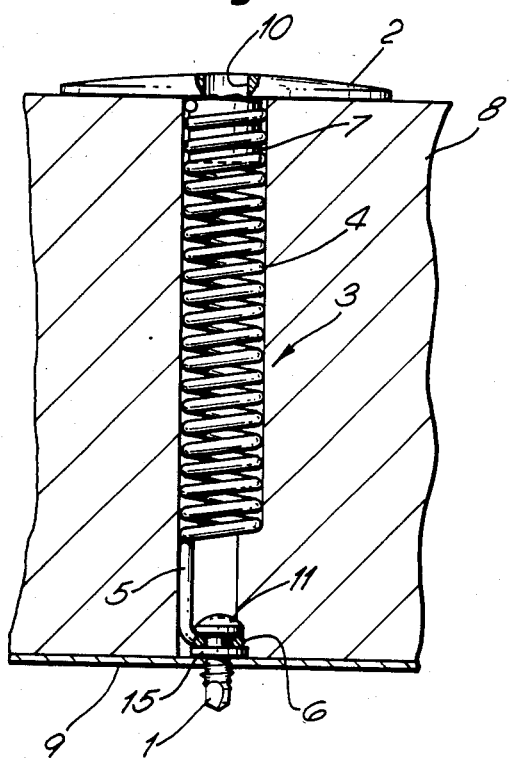
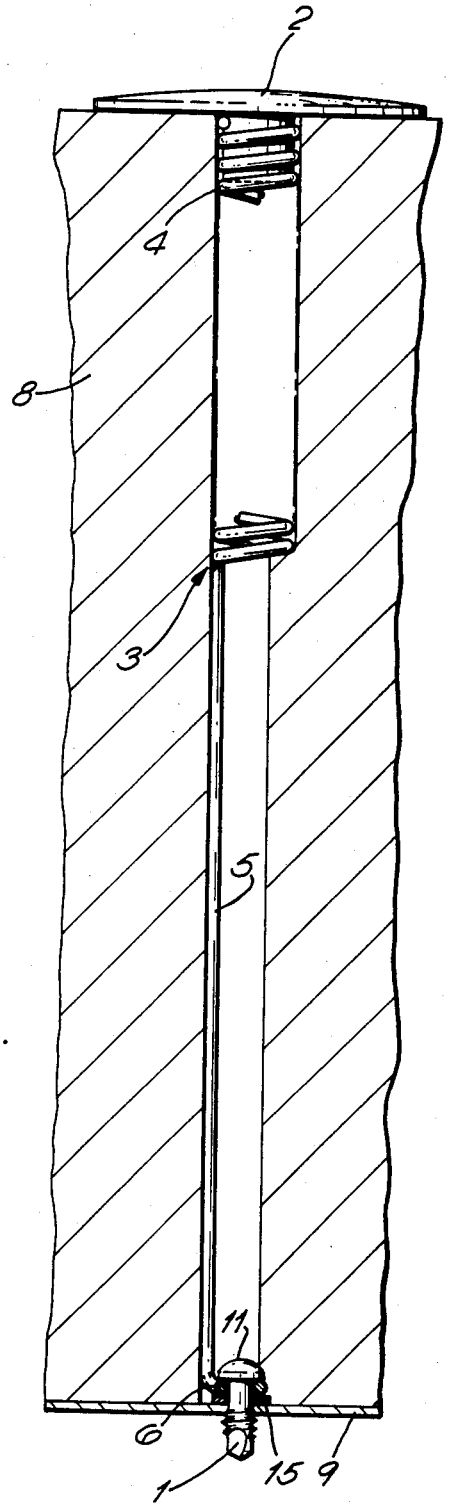
Fig. 2.

FASTENING ASSEMBLY

BACKGROUND TO THE INVENTION

This invention relates to fastening assemblies for fastening compressible insulation material onto a roof decking. A built up roof is made by providing a relatively thin sheet metal roof decking covering a framework of structural steel members. Insulation material such as mineral wool mat is then laid over the decking and secured in place by fastener assemblies. The insulation material and fastener assemblies are then covered by a waterproof membrane, for example a butyl rubber sheet or by a combination of roofing felt and a bitumastic sealing compound.

Recently it has been proposed that much thicker layers of insulation material are used in such roof construction. Recently it has been proposed that the thickness of the insulation be increased to a thickness within a range from 130 to 300 mm. One particular application of this is to provide a gravity fall on a flat roof deck by providing a graduated thickness of insulation material over the roof decking to convert a flat roof into one having a shallow pitch.

SUMMARY OF INVENTION

According to this invention a fastening assembly for use in fastening a thick insulating layer onto a roof decking comprises a self drilling and self tapping screw-threaded fastener having a driving head; a load distributing plate for engaging the upper surface of the insulation material to hold the insulation material and distribute the fastening load so that the fastening assembly does not pull through the insulation material; and, an extensible resilient member having one end coupled to the head of the screw-threaded fastener and the other end coupled to the load distributing plate, at least one coupling permitting the screw-threaded fastener to rotate with respect to the load distributing plate to allow the fastener to be driven through and screwed into the roof decking to fasten the insulation material.

The provision of a resilient element between the load-distributing plate and the screw-threaded fastener firstly enables the insulation material to be held under a substantially constant tensile load irrespective of minor variations in the manufacture of the insulation material, and distortions and deformations of it that occur in use. Such deformations can occur by the ageing of the material or during the application of an external load to the roof, for example a snow loading or a wind loading, or as a result of roof traffic. Another cause of deformation in the insulation material is the way it settles at the corrugations of the roof decking due to roof load. In addition to this the resilient element also accommodates any lateral movement of the load-distributing plate and the screw-threaded fastener caused by, for example, thermal expansion and contraction or settlement of the building.

The resilient element may be formed by a polymer spring or an extensible element of rubber or rubber-like elastomeric material. In this case the resilient element may be moulded integrally with the load-distributing plate at one end and its other end preferably includes a fixing including a circular aperture to enable the screw-threaded fastener to be coupled to it and to enable the screw-threaded fastener to rotate with respect to the element. Preferably the resilient element is formed by a helically wound wire tension spring having at one end a turn of smaller diameter than the remainder through which the screw-threaded fastener passes and against which the head of the screw-threaded fastener engages to form the coupling between the fastener and the spring. The turn of smaller diameter may be spaced from the remainder of the spring by a straight and generally axially extending arm portion. A range of fastening assemblies may be provided and these may have different lengths of axially extending arm portions to enable the fastening assemblies to suit a variety of different thicknesses of insulation material.

Preferably the load-distributing plate includes a depending projection carrying an external helical track and the other end of the helically wound wire tension spring is coupled to the load-distributing plate by being wound onto this projection with the turns of the spring being received in the track. In this case the helix angle of the track on the projection preferably corresponds to the helix angle of the spring under its normal load condition. Firstly this ensures that the portion of the projection remaining between adjacent turns of the track have sufficient strength to support the spring and secondly ensures that the spring is subjected to a substantially constant loading throughout its connection with the load-distributing plate and this avoids problems such as fatigue failure caused by any point loading on the spring.

As an alternative to this the one end of the spring which is coupled to the load-distributing plate may be formed with a single turn having a steeper helix angle than the remainder of the spring and then this portion of the spring is coupled with the load-distributing plate by winding this single turn of the spring with the steep helix angle into a correspondingly shaped portion of the load-distributing plate in an analogous fashion to the connection between a corkscrew and a cork. The single turn of the large helix angle is preferably concluded with a short end portion of the spring having a zero helix angle. Preferably the corresponding portion of the load-distributing plate includes a helical surface to support the end of the spring having a zero helix angle and, in this case, the final straight portion of the spring with zero helix angle co-operates with the helical surface on the load-distributing plate to provide a substantially uniform load-distribution around the entire angular extent of the load-distributing plate and again avoids point loadings leading to fatigue failure.

Often the lower surface of the insulation material is covered by an impermeable membrane to provide a vapour barrier between the top of the roof decking and the lower surface of the insulation material. This impermeable vapour barrier prevents water vapour passing upwards through the insulation material and then condensing on the lower surface of the waterproof membrane with the resulting accumulating of water in the roof structure. In this case the fastening assembly preferably includes a rubber or rubber-like elastomeric washer located between the coupling between the head of the screw-threaded fastener and the resilient element, and the impermeable vapour barrier located on top of the roof decking. The rubber or rubber-like elastomeric washer forms a vapour-tight seal around the fastener and this ensures the integrity of the impermeable vapour barrier even though the screw-threaded fastners penetrate the impermeable membrane. The rubber or rubber-like elastomeric washers also engage the fastener closely and help to maintain the coupling between the fastener and the resilient element.

Preferably the screw-threaded fastener includes a thread-free portion adjacent its head and its screw-thread runs cleanly into this thread-free portion. As the screw-threaded fastener is coupled to the one end of the resilient element the one end of the resilient element is received in this unthreaded portion so that the fastener is held captive by the resilient element but so that it can rotate with respect to the one end of the resilient element. When the fastening assembly also includes a rubber or rubber-like elastomeric washer this is also preferably received in this unthreaded portion. Preferably the unthreaded portion is greater in axial extent than the axial extent of the one end of the resilient element and, where provided, the washer, and preferably it is greater by an amount corresponding to the thickness of the roof decking into which the fastener is to be driven. In this case, in use, the screw-threaded fasteners are driven until the roof decking runs out into the unthreaded portion. This ensures a constant driving of the fasteners. It is impossible to over-drive the fastener and there is no need for complex torque measuring or resilient element extension measuring systems. The length of the screw-threaded fastener which extends through the roof decking is also constant. In this case the screw thread on the fastner is preferably generally tapered with the turn of the thread adjacent the groove or unthreaded portion having the maximum diameter.

It is preferred that the screw-threaded fastener includes a drilling point. To ensure that the final turn of the thread adjacent the unthreaded portion is formed effectively a groove may be rolled in the unthreaded portion to collect enough material to form a well defined final turn of thread.

The load-distributing plate is preferably formed by injection moulding from a thermoplastics material such as polypropylene. The load-distributing plate is domed in its relaxed state so that when it is placed under load it flattens out to exert a substantially constant load over its entire area. The plate may be circular, generally square with rounded corners or, to obtain an even greater distribution of the load it may be generally X-shaped with rounded lobes at the ends of the two arms of the X. Preferably the underside of the load-distributing plate includes a number of ribs extending generally radially outwards to engage the upper surface of the insulation material and help prevent rotation of the plate whilst the fastener is driven into the roof decking. The load distributing plates may be made in a range of different colours so that fastening assemblies of a particular overall length have a particular colour of load distributing plate. This enables a fastening assembly of appropriate length for a particular location to be identified readily.

Preferably the load-distributing plate also includes a central aperture through which a driving tool is inserted to engage the driving head of the screw-threaded fastener to rotate it and drive it into the roof decking. In this case it is preferred that the upper surface of the load-distributing plate surrounding the aperture includes a lip or a series of resilient fingers extending across the aperture to help prevent butumastic sealing compound entering the aperture and coating the spring, so adhering adjacent turns together and preventing its free operation. Instead of these the central aperture may be closed by a removable plug. The periphery of the plate may also include a lip to co-operate with a driving tool.

When the resilient element is formed by a helically wound wire tension spring with its adjacent turns touching in their relaxed state, the fastening assembly preferably includes means to prevent the insulation material becoming trapped between adjacent turns of the spring. This means may be formed by a sleeve or tube of plastics material surrounding the outside of the turns of the spring.

BRIEF DESCRIPTION OF DRAWINGS

A particular example of a fastening assembly in accordance with this invention will now be described with reference to the accompanying drawings, in which:

FIG. 1 is a sectional elevation through a first example of a fastening assembly in use;

FIG. 2 is a sectional elevatioln through a second example of a fastening assembly in use;

DESCRIPTION OF PREFERRED EXAMPLES

Figure 3:
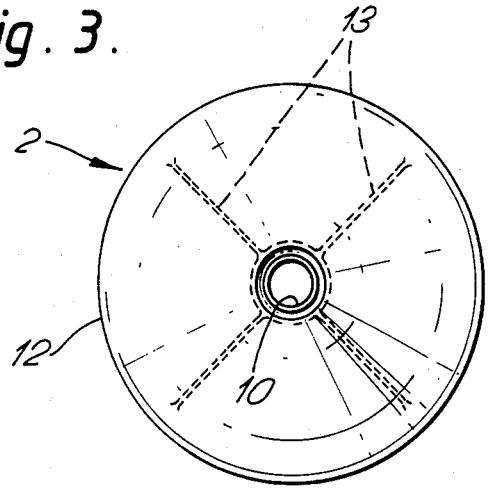
FIG. 3 is a top plan of a load-distributing plate.

This example of fastening assembly comprises a self-drilling and self-tapping screw-threaded fastener 1, a load-distributing plate 2 and an extensible resilient member 3. The extensible resilient member 3 is formed by a helically wound wire tension spring 4 having at its lowermost end an axially extending arm portion 5 which terminates in a single turn 6 of small diameter. The upper end of the spring 4 is wound onto a projection 7 depending from the load-distributing plate 2 as will be explained in more detail subsequently and the screw-threaded fastener 1 passes through the turn 6 of small diameter.

Figure 4:
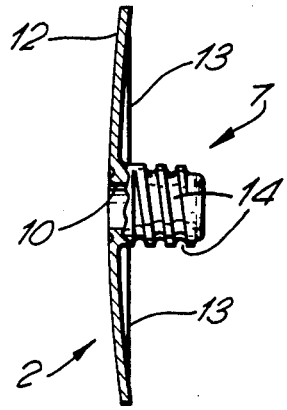
FIG. 4 is a partly sectioned side elevation of the load-distributing plate.
Figure 5:
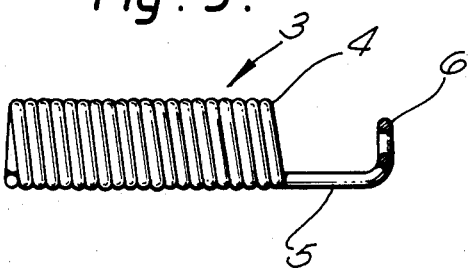
FIG. 5 is a side elevation of the resilient element.
Figure 6:
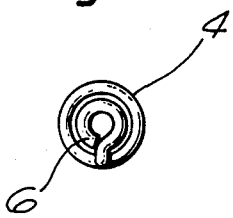
FIG. 6 is an end elevation of the resilient element.
Figure 7:
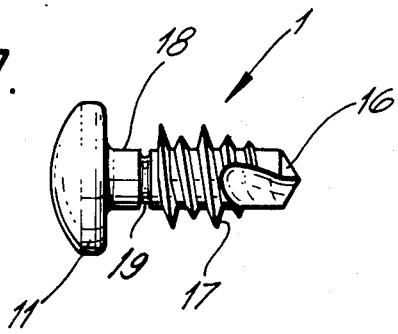
FIG. 7 is a side elevation of the screw-threaded fastener.

In use this fastening assembly is used to attach a thick layer of insulation material 8 having a thickness typically 130 mm and which may be as great as 300 mm to a metal roof decking 9. Typically this metal roof decking 9 is corrugated with trapezoidal corrugations. An impermeable membrane may be laid between the insulation material 8 and the roof decking to prevent water vapour permeating through the insulation material 8 and condensing to form water beneath a waterproof membrane laid over the insulation material 8. A screw driving tool passes through an aperture 10, shown most clearly in FIGS. 3 and 4 formed in the load-distributing plate 2 and engages a head 11 of the fastener 1. The fastening assembly is then pushed through the insulation material 8 and then driven by the screw driving tool through the roof decking 9. To accommodate different thicknesses of insulation material 8 the extensible resilient member 3 is provided with a variety of lengths of axially extending arm portion 5, as shown in FIGS. 1 and 2. The number of coils in the spring 4 also varies with the thickness of the insulation material 8 and the length of the extensible resilient member 3 and there are typically between sixteen and twenty-two working coils.

The load-distributing plate 2 is injection moulded from polypropylene and includes a circular domed head 12 with four radially extending ribs 13 projecting downwards from its lowermost surface. The projection 7 includes a helical track 14 surrounding its projection 7. The helical track 14 is arranged to complement the turns 4 of the spring 3 in their loaded state, and the projection 7 is screwed into the upper few turns of the spring 4 to couple the plate 2 onto the spring 4. A plug not shown can be inserted into the aperture 10 to prevent bitumastic sealing compound from passing down through the aperture 10.

A rubber or rubber-like washer 15 is included on the screw beneath the turn of small diameter and this grips the shank of the fastener 1. This washer helps to hold the fastening in its assembled condition but principally it is provided to form a vapour-tight seal beneath the head 11 of the fastener 1. Naturally this is particularly important when the roof includes the impermeable membrane.

The screw-threaded fastener 1 includes a self-drilling point 16 with a tapering screw thread 17. A thread free portion 18 is included in the shank of the fastener 1 between a tapering screw thread 17 and the head 11 and this has sufficient axial extent to accommodate the turn 6 of smaller diameter of the spring 3, the washer 15 when tightly compressed, and the roof decking 9. To ensure that the final turn of the screw thread 17 is formed perfectly, a groove 19 is preferably rolled into the thread-free portion 18. The head 11 includes a driving recess such as a number 3-type Philips driving recess.

The fastening assembly is provided in an assembled condition with the spring 3 screwed onto the projection 7 of the load-distributing plate 2 and with the reduced diameter turn 6 of the spring 3 engaged in the unthreaded portion 18 of the screw-threaded fastener 1. As the fastening assembly is pushed through the insulation material 8 the load-distributing plate 2 engages the upper surface of the insulation material 8 and then further downwards movement of the screw driving tool extends the turns 4 of the spring 3 until the drilling point 16 of the fastener is in contact with the roof decking 9. Rotation of the fastener 1 causes the drilling point 16 to drill through the roof decking 9 and further rotation causes the self-tapping screw 17 to cut a screw thread in the roof decking 9. As the screw fastener 1 is driven through the roof decking 9 the turns 4 of the spring 3 are further extended as the fastener 1 is screwed into the decking hence the screw 1 is rotated until the roof decking 9 runs out of the screw thread into the thread-free portion 18. The shoulder formed by the run out of the screw thread at the lowermost edge of the thread-free portion 18 resists the tension exerted by the spring 3 to prevent the screw 1 pulling out of the roof decking 9 whilst, ensuring that the screw 1 is always inserted to the correct extent to provide the required tensile load on the load-resisting plate 2 to hold the insulation material 8 onto the decking 9. The washer 15 is lightly compressed between the turn 6 of the spring and the decking 9 or impermeable membrane when this is included.

I claim:

1. A fastening assembly for fastening a thick insulating layer onto a roof decking, said fastening assembly comprising:

a screw-threaded fastener;

a load distributing plate; and an extensible resilient element, said screw-threaded fastener including a shank having a first and second end, a driving head at said first end of said shank, a drill point at said second end of said shank, and a self-tapping screw thread formed around said shank;

said loading distributing plate having a lateral extent substantially greater than said screw-threaded fastener and said extensible resilient element, said plate being adapted to engage an upper surface of said insulation material to hold said insulation material and distribute a fastening load whereby said fastening assembly is prevented from pulling through said insulation material, said plate having a central through opening to allow relation of said screw-threaded fastener by a driving tool extending through said plate;

said extensible resilient element including opposed ends and coupling means located at said opposed ends and coupling said extensible resilient element to said first end of said shank of said screw-threaded fastener and to said load distributing plate, said coupling means permitting said screw-threaded fastener to rotate with respect to said load distributing plate to allow said fastener to be driven through and screw-threaded into said roof decking to fasten said insulation material to said roof decking.

2. The fastening assembly of claim 1, wherein said resilient element comprises a helically wound wire tension spring and said coupling means includes a turn of smaller diameter than the remainder of said spring formed at one end of said spring; said shank of said screw-threaded fastener passing through said turn of smaller diameter and said head of said screw-threaded fastener engaging said turn of smaller diameter to complete coupling between said screw-threaded fastener and said resilient element.

3. The fastening assembly of claim 2, wherein said turn of smaller diameter is spaced from said remainder of said spring by a straight arm portion extending generally parallel to the axis of said helical spring.

4. The fastening assembly of claim 2, wherein said load-distributing plate includes a depending projection and an external helical track formed on said depending projection, said other end of said helically wound wire tension spring being wound onto said projection with turns of said spring being received in said track to provide at least part of said coupling means.

5. The fastening assembly of claim 4, wherein the helix angle of said track on said projection corresponds to the helix angle of said spring when said spring is subject to a normal lead condition.

6. The fastening assembly of claim 1, which also includes a washer, said washer being located on said shank of said fastener, said washer being located on the side of said coupling means of said resilient element remote from said head of said fastener.

7. The fastening assembly of claim 6, wherein said shank of said screw-threaded fastener includes a thread-free portion at its first end adjacent its head, and wherein said screw-thread run cleanly into said thread-free portion.

8. The fastening assembly of claim 7, wherein said screw-thread tapers with its maximum diameter adjacent said thread-free portion, and wherein a groove is formed in said thread-free portion to provide sufficient material to ensure that a final turn of said thread is formed correctly.

9. The fastening assembly of claim 8, wherein said one end of said resilient element is received in said thread-free portion whereby said fastener is held captive by said resilient element.

10. The fastening assembly of claim 7, wherein said one end of said resilient element is received in said thread-free portion whereby said fastener is held captive by said resilient element.

11. The fastening assembly of claim 1, wherein said shank of said screw-threaded fastener includes a thread-free portion at its first end adjacent its head, and wherein said screw-thread runs cleanly into said thread-free portion.

12. The fastening assembly of claim 11, wherein said screw-thread tapers with its maximum diameter adjacent said thread-free portion, and wherein a groove is formed in said thread-free portion to provide sufficient material to ensure that a final turn of said thread is formed correctly.

13. The fastening assembly of claim 1, wherein said load-distributing plate is formed by injection moulding from a thermoplastics material, said load-distributing plate being domed when in a relaxed state whereby when said plate is placed under load, said plate flattens out to exert a substantially constant load over said surface of said insulation material.

* * * * *